US005927085A

United States Patent [19]

Waldman

[11] Patent Number: 5,927,085

[45] Date of Patent: Jul. 27, 1999

[54] COMMERCIALLY VIABLE COUNTER-TOP BEVERAGE DISPENSER WITH PASSIVE THERMAL INSULATION

[76] Inventor: Joseph Waldman, 303 S. Snedecor Ave., Bayport, N.Y. 11705

[21] Appl. No.: 08/907,370

[22] Filed: Aug. 7, 1997

[51] Int. Cl.[6] ..... F25D 3/08

[52] U.S. Cl. ..... 62/129; 62/457.4; 215/395; 220/592.17; 220/23.89

[58] Field of Search ..... 62/457.2, 457.4, 62/129; 215/395, 396; 220/23.87, 23.89, 592.1, 592.16, 592.17, 903

[56] References Cited

U.S. PATENT DOCUMENTS

| | | | |
|---|---|---|---|
| 1,999,670 | 4/1935 | Strouse et al. | 220/592.16 |
| 2,039,736 | 5/1936 | Munters et al. | 62/457.4 |
| 3,273,354 | 9/1966 | Gibson | 62/457 |
| 3,302,427 | 2/1967 | Stoner et al. | 62/457 |
| 3,823,567 | 7/1974 | Corini | 62/3 |
| 4,163,374 | 8/1979 | Moore et al. | 62/457 |
| 4,183,226 | 1/1980 | Moore | 62/457 |
| 4,218,967 | 8/1980 | Batchelor | 99/472 |
| 4,338,795 | 7/1982 | House, Jr. | 62/372 |
| 4,383,422 | 5/1983 | Gordon et al. | 62/457 |
| 4,485,636 | 12/1984 | Hilado | 62/430 |
| 4,870,837 | 10/1989 | Weins | 62/457.4 |
| 4,961,324 | 10/1990 | Allan | 62/457.4 |
| 4,981,234 | 1/1991 | Slaughter | 220/415 |
| 5,001,907 | 3/1991 | LaCroix et al. | 62/457 |
| 5,366,102 | 11/1994 | Bergner et al. | 215/395 |
| 5,406,808 | 4/1995 | Babb et al. | 62/457.4 |
| 5,444,989 | 8/1995 | Gawron et al. | 62/457.2 |
| 5,555,746 | 9/1996 | Thompson | 62/457.4 |
| 5,572,872 | 11/1996 | Hlavacek | 62/3.6 |
| 5,653,124 | 8/1997 | Weber | 62/457.4 |

*Primary Examiner*—William E. Tapolcai
*Attorney, Agent, or Firm*—Mark E. Bender

[57] ABSTRACT

A beverage carton dispenser for self-service coffee distribution is provided with passive thermal insulation, a locking means to prevent undesirable beverage-carton slip-out during times when a user employs a steep pouring angle. A vent aperture is provided to relieve inner-air pressure when a milk carton is being installed or removed. A pour handle and re-useable refrigerant gel are also provided. The device is simple, inexpensive and solves the problem of providing a commercially viable counter-top milk dispenser which keeps milk cold in a room-temperature environment without the use of open ice with dripping and puddling water and without active refrigeration requiring an energy input. The presence of the pour handle makes dispensing the beverage easier, safer, and more convenient and provides the user with greater control over pouring the beverage from the container.

23 Claims, 4 Drawing Sheets

COMMERCIALLY VIABLE COUNTER-TOP BEVERAGE DISPENSER WITH PASSIVE THERMAL INSULATION

BACKGROUND OF THE INVENTION

In commercial coffee distribution it has long been a problem that where coffee self-service is provided at restaurants, delicatessens, convenience stores and similar locations, milk for coffee self-service is typically provided in an un-insulated carton. The milk carton is placed on a counter near the coffee dispenser, and the milk may remain on the counter for a period of time, possibly for hours. In some cases, the milk may be cooled by placing it into a pan or container with ice. In other cases, milk may be kept in a refrigerator, and the milk carton removed from the refrigerator when milk is desired for coffee.

But un-insulated milk quickly warms up to room temperature, and bacteria growth swiftly ensues, spoiling the milk.

For public health reasons, many jurisdictions require that milk and other dairy products be maintained at temperatures typically at or below 40 degrees Fahrenheit. If milk is permitted to remain unchilled for an hour or more its temperature becomes hygienically unacceptable and probably violates a public health food-handling ordinance.

A coffee-service milk container in a commercial setting such as a convenience store, office or restaurant may sometimes be placed into a pan having ice therein to try to keep the milk cold. But as the milk stands at room temperature and is used by coffee-drinkers, two things happen.

First, the ice melts, causing a pool of water, which clings to and drips off the bottom of the milk container when milk is poured.

The result is an inconvenient mess, a clean-up problem and possibly a slippery floor occasioned by a melt-water puddle, which has found its way to the floor of the premises. Water accidentally dripped from a milk container or condensed from an ice pan can be a negligence condition for the proprietor of the coffee-self service facility because the proprietor knows, or by the exercise of reasonable care, should know, that a wet floor can easily eventuate from an ice pan on a counter top and a wet floor is a slip and fall hazard for persons who it is foreseeable will visit the coffee self-service vicinity.

In fact the proprietor seeks to generate business profit by implicitly attracting coffee customers to the coffee self-service area by merely having the coffee service available. Such negligence reasoning is not lost on proprietors or insurance carriers writing policies of commercial coverage protecting proprietors against customer injuries.

A water puddle regularly forming in the same coffee-service vicinity is an enhanced slip-and-fall injury hazard due to the fact that hot liquids [coffee] may be held by a slip-and-fall victim at the time of a fall, causing incidental scalding to the victim or other persons in the area.

It is prohibitively difficult or impossible to operate a coffee self-service operation non-negligently using either an ice pan or a conventional refrigerator to keep the milk cool [where the milk carton is repeatedly withdrawn from the refrigerator] because doing so requires the proprietor to be extremely vigilant for slip-and-fall hazards occasioned by puddles of condensed water from the ice pan, or cold milk carton.

Even a small puddle which recurs regularly in the same spot can subject the proprietor to a claim for injury from a slip-and-fall victim on grounds that the proprietor had knowledge for a long time prior to the slip-and-fall that a water puddle typically formed in precisely the location which occasioned the victim's fall and consequent injuries. The claimant will typically accuse the proprietor of being on notice of the recurrent floor puddle that constituted a defective condition at the time and place of the injury.

Worse yet will be the accusation that the proprietor not only knew of the puddle-slippery floor condition—but also that the proprietor actually created the dangerous condition by setting a milk container in an ice pan which was bound to result in a puddle when the milk was repeatedly withdrawn from the ice pan by coffee self-service customers.

Another problem with using a simple ice pan for cooling a coffee-station milk container is that the bulk of the milk volume is not exposed to being chilled in a thermally efficient manner because only the bottom of the milk container is typically in contact with the ice or ice-water in the pan.

What has been needed, and what is provided in the present invention is a simple, inexpensive, convenient, passively insulating dispenser for milk and other beverages contained in cartons similar to milk containers. The milk or other beverages are thus made available for self-service by users, such as coffee-drinker self-service, drinking water self-service, fruit juice self-service, and the like.

Although the present invention is described as a convenient insulator for milk cartons, it is also useful for any kind of beverage self-service with any kind of carton-contained beverage. Commercial coffee self-service is only one of the specific contexts in which the present invention is useful.

In fact the present invention may be used for any kind of beverage self-service, whether or not commercial. Milk self-service is not necessarily associated with coffee service, and keeping beverages chilled while the container stands at room temperature is applicable to any number of applications, such as fruit juice self service, party beverage self-service and the like.

Although the present invention is here described as primarily as an insulated receptacle for a milk-carton in the context of commercial coffee self service, it is nonetheless useful for beverage self-service in such situations as commissaries, cafeterias, restaurants, and many others.

The beverage dispenser of the present invention may be specifically for milk and the dispenser may be placed in a location convenient for coffee self-service, typically near a self-service coffee dispenser and always in a room-temperature location. The present invention is constructed to have dimensions so as to snugly hold a milk or similar beverage container in a frame having a convenient pouring handle.

The present invention eliminates all the problems with placing a milk or other beverage container into a pan of ice because the dispenser of the present invention is simply a block-shaped rectangular frame having an outer shell, preferably made of plastic on which advertising indicia may be printed. On the inner side of the outer shell the present invention is provided with thermal insulation means, preferably a soft foam thermal insulated lining defining a rectangular cavity corresponding to the shape of a beverage container, such as a standard milk carton. However, there are other thermal insulation means in addition to snug-fitting foam. For instance, although not preferred in this invention, an inner liner could be used with an evacuated space between the inner and outer liner provided—in the manner of a vacuum bottle.

The present invention preferably employs soft foam thermal insulation to firmly grasp a milk or other beverage carton nested therein. The foam cavity shape closely matches the dimensions of the milk carton or other beverage carton. In the present invention, soft foam wafers may be provided to stuff into the space between the receptacle and a beverage container of non-standard size. In addition, the receptacle of the present invention may be made in more than one size, so as to fit a variety of standard size beverage containers. For example, one-quart and half-gallon milk cartons are widely distributed well-known container sizes. The preferred embodiment of the present invention is made to match and fit the standard one-quart carton.

But the receptacle of the present invention may be made smaller or larger, so as to fit, for example a one-quart carton, or a one-pint carton, and so forth but without being limited thereto.

The foam-lined receptacle of the present invention is preferably topless but may be provided with an insulated removable top. The milk carton nested therein is intended to have its standard foldable pour spout projecting from the open top of the receptacle, which is provided with a pour-handle.

In a preferred embodiment the tops of two opposite sides of the receptacle have contouring which curls inwardly to comprise a pair of flexible retaining flaps for contacting the top angled shoulders of a milk or other beverage carton nested within—thus securing the milk carton and preventing it from inadvertently sliding out of the grasp of the foam insulation during times when the user is employing a steep pouring angle as will happen when the beverage carton is almost empty and the last quantity is being poured out.

The two opposing flexible retaining flaps are identical and are constructed so as to permit the user to use his or her fingers to pull one of them aside when inserting or removing a milk carton. When inserting a carton with one of the retaining flaps thus pulled back to make way, the carton is inserted into the foam inner cavity, or nest of the present invention at an angle so as to avoid being blocked from entry into the nest by the other flexible flap. When the milk or other beverage carton has been inserted sufficiently deeply into the nest, the user merely releases finger pressure upon the flexible retaining flap which has been pulled back to permit insertion, and the milk carton drops the remaining distance into its fully nested place.

The pulled-back retaining flap, when released by the user, resiliently resumes its form and comes into contact with the angled shoulder of the fully nested milk carton. The angled shoulders of the milk carton are the sloping sides of the carton's folded top, as distinguished from the front or the back of the milk carton top.

In an alternate embodiment, the retaining flaps of the present invention are comprised only of contoured extension portions of the outer shell, as distinguished from the above-described preferred flaps, which are comprised, of contouring of the combined outer shell-with-foam-insulation.

The passive thermal insulating soft cell foam of the present invention is preferably provided with re-freezable gel, disposed in one or more recesses provided to accommodate the gel in both the lower sides and the bottom portion of the soft-foam cavity. The refrigerant gel is permanently installed in at least one recess in the foam cavity. A non-preferred embodiment of the present invention has no refrigerant gel, and is also not provided with recesses to accommodate the gel.

The at-least-one recess is preferably in the bottom portion of the foam cavity and also within the lower portions of the sides of the cavity as well.

The gel-equipped receptacle is designed to be repeatedly placed into a freezer so as to freeze the gel. When withdrawn from a freezer and supplied with a milk or other beverage carton on a counter-top in a commercial coffee or other beverage self-service environment, the built-in refrigerant gel of the present invention will assist in maintaining acceptably cold beverage temperature. The natural resilience of the soft thermal insulating foam, which comprises the carton nest of the present invention also accommodates the natural mechanical volumetric expansion of the refrigerant gel as it is frozen.

A non-preferred embodiment of the present invention employs refrigerant gel, which is removable from the foam cavity recesses in the receptacle, so that the refrigerant gel may be separately placed in a freezer for re-freezing. The preferred embodiment of the present invention provides for the refrigerant gel to remain permanently installed in the foam recesses, with the entire receptacle being repeatedly placed in a freezer for re-freezing the gel after each use.

Because the at-least-one refrigerant gel recess in the foam nest is disposed at or near the bottom of the milk carton cavity, additional mass is thus supplied to the lower portion of the present invention, thereby lowering its center of gravity and making the present invention more stable and easier to control in the hand of a user pouring a beverage. Because the center of gravity is thus lowered, the user who grasps the pour handle of the present invention finds the receptacle more positionally stable than is possible without a lowered center of gravity.

In a non-preferred embodiment, the present invention may be provided with a thermally insulated cap for use during time periods when a milk or beverage container may stand at room temperature for extended time periods, as when, for example, a commercial coffee self-service operation encounters a period of slow customer activity.

Some of the related art, as, for example, with U.S. Pat. No. in 3,273,354 to Gibson, which is more fully described elsewhere, provides for a re-freezable material in a top portion. Such addition of mass in the top portion of a beverage dispenser placed in commercial service for use by the public is dangerous due to the likelihood of infirm persons failing to exert sufficient gripping force to safely handle the pour, and possibly spilling hot coffee on themselves or others as a result.

The presence of infirm persons or children or persons who may be distracted from paying attention to what they are doing in a self-service coffee environment is clearly foreseeable when a careful coffee self-service proprietor conducts a duly diligent anti-negligence review of procedures and practices.

The re-freezability of the entire receptacle of the present invention makes it convenient for a coffee service proprietor to use, since the fewer parts and the fewer operations needed to provide and maintain coffee self service, the more economical and profitable will be the coffee service. It may not always be practical to have the refrigerant gel removable from the receptacle for re-freezing, and then have the same re-installed into the receptacle because, doing so adds to the cost of production and comprises an additional operation requiring the time and the attention of a busy coffee service proprietor and his or her staff.

Consequently, the preferred embodiment of the present invention encompasses non-removable refrigerant gel. However, an alternate, non-preferred embodiment provides for the gel to be removable from its recesses for cleaning and refreezing.

The preferred embodiment of the present invention is also provided with a drain aperture in the bottom of the receptacle. The drain aperture penetrates from the floor of the foam nest downward to outlet at the bottom of the outer shell of the present invention.

The drain aperture serves to bleed air out of and into the receptacle upon the respective installation or removal of a milk carton, since the fit of the carton within the foam cavity is snug.

In addition, the floor of the foam cavity surrounding the drain aperture is depressed surrounding the drain itself, so as to permit condensate from the cold milk carton or the refrigerant gel, or both, to conveniently drain and thus escape. Such depressed contouring of the floor of the nest of the present invention is provided whether or not the invention is provided with the preferred refrigerant gel.

The present invention will generate practically no condensate, unlike the above-described problems with ice-pan milk cooling or cooling a bare milk carton in a conventional refrigerator and removing it each time milk for coffee is desired. By comparison, the ice pan or bare milk carton produce relatively large volumes of condensate.

The present invention minimizes condensate and eliminates the danger of condensate puddles because the foam insulation of the carton nest, combined with the refrigerant gel of the preferred embodiment, maintains an effective, but passive, thermal insulation of the milk as it stands on a counter top at room-temperature conditions.

Alternatively, in a non-preferred embodiment, and in order to permit efficient drainage of condensate, the floor of the milk carton nest may be ribbed so as to provide a plurality of drain channels in the floor, directing condensate to the drain aperture.

The outer shell of the present invention may be made of a suitably inexpensive material such as plastic, and is made of a material and has a surface texture capable of being imprinted with advertising indicia if desired.

The present invention solves the problem of making milk safely and conveniently available to coffee self-service customers in a commercial environment where milk containers are now typically left thermally unprotected or are placed in a messy, dangerously drip-producing ice bath.

The present invention therefore discloses a commercially acceptable milk dispenser for coffee self-service which is simple, uncomplicated, requires little or no maintenance and is inexpensive. Toward that end, the preferred embodiment of the present invention is a simple frame, preferably made of a suitable plastic material, having insulating foam with permanently installed re-freezable refrigerant gel installed in recesses in the lower sides and bottom of the foam container. An alternate non-preferred embodiment of the present invention provides gel-ice inserts, which are not permanently installed, but rather are removable for cleaning and re-freezing. In a commercial coffee-service environment a refrigerator-freezer for refreezing the refrigerant gel is typically available so that the commercial proprietor using the present invention can easily re-freeze the refrigerant gel as needed.

While the preferred embodiment of the present invention provides the above-described anti-slip-out retaining flaps where the foam insulation is coextensive with the flaps, a non-preferred embodiment provides the retaining flaps merely being non-insulated extensions of the outer walls of the receptacle. Yet another non-preferred embodiment of the present invention provides a receptacle with no retaining flaps at all, the milk or other beverage carton being held in place only by the snug friction fit of the foam insulation.

In addition, the present invention is provided with a plurality of accessory cell foam shims which are wafer-like thin and flat pieces of cell foam whose length and width permit them to be inserted between a non-standard container and the cell foam nest of the present invention for making the non-standard container fit within its cell foam nest as snugly as the user desires. The shims are thus for user-adjustment of the sizing the cell foam nest so as to ensure that a non-standard container is both snugly fitted within the nest and also thermally insulated in the simplest, most cost effective and most thermally efficient manner.

The related art contains beverage and milk refrigeration devices which are either active refrigerators or are not specifically suitable to milk self-service in a commercial coffee service environment.

By contrast to active refrigeration devices, the present invention provides only passive thermal insulation for the milk nested therein. Such passive insulation is commercially attractive because the present invention is inexpensive to manufacture, to purchase and to keep clean, does not require a source of energy to drive active refrigeration, and does not require maintenance of active refrigeration equipment.

U.S. Pat. No. 5,572,872 to Hlavacek discloses a liquid cooling, storing and dispensing device comprising a refrigerator requiring an energy supply for active heat transfer [refrigeration]. The Hlavacek device requires heat dissipation means and the refrigeration unit is mounted on the side of the dispenser. There is no means for the Hlavacek device to actively grasp the milk carton or to prevent it from slipping out if the milk is poured at a steep pouring angle. A steep pouring angle is encountered when a carton of milk is almost empty and the user is attempting to pour out the last remaining contents.

Hlavacek's device also has a user-openable top portion 21 attached with a hinge to bottom portion 20. The present invention eliminates a top portion altogether for simplicity, for user convenience, and for ease of cleaning and maintenance. An openable top such as Hlavacek has is a major inconvenience to coffee self-service customers, who typically wish to spend as little time at the self-service coffee counter as possible.

The present invention eliminates the customer inconvenience of having to remove the Hlavacek top in order to pour milk. This is especially important to coffee customers who may have medical problems making lifting and pouring of a milk container difficult. Neuro-muscular deficits resulting from injuries or such diseases as arthritis can make grasping, lifting and pouring activities of significant difficulty. Any reduction in the need for fine eye-hand coordination and finger manipulation—such as eliminating the top portion of the Hlavacek device—is an important improvement in the commercial viability of an insulated beverage receptacle such as the present invention.

Further, the device of Hlavacek fails to secure the milk carton within the receptacle. Unlike the present invention, there is simply no means in Hlavacek to prevent slide-out during steep pouring angles. Thus the device of Hlavacek presents a hot-liquid safety hazard in a commercial coffee self-service environment.

Because the device of Hlavacek presents an external heat sink, it is possible for a user to accidentally come into contact with the heat-dissipating unit 16 of Hlavacek. Such a temperature difference could startle the infirm user into dropping the entire device, and possibly spilling hot coffee. This is especially true in a commercial environment, where negligence concerns dictate that a commercial proprietor must make preparation for customers who may have every foreseeable kind of human deficit, such as limitations which are physical, neurological, physiological, muscular, psychological, and so forth.

Maintaining commercial insurance coverage requires a proprietor to use reasonable care to avoid foreseeable risks of harm to customers—which takes the form of having to assume customers may foreseeably hurt themselves, and to guard against such injury in every possible way. Doing so is the only way to operate coffee self-service in a non-negligent manner.

There are multiple problems with the device of Hlavacek making it unacceptable in a commercial coffee self-service environment. To begin with, Hlavacek's side-mounted refrigerator is not only expensive to purchase, but is clumsy and ungainly and thereby creates a problem for self-service coffee users in that the weight imbalance and the physical obstruction resulting from the existence of the side-mounted refrigerator will cause the threat of users dropping the container, mis-pouring the milk contents, and bumping or brushing the refrigerator extension against portions of their own skin or clothing, against portions of the skin or clothing of others in the coffee self-service area, or against objects in the vicinity, such as a full cup of hot coffee.

The commercial disadvantage of Hlavacek is serious because just a mere threat of the above-described hot coffee spill is sufficient to completely ruin commercial viability due to likelihood of an injury claim.

Injury claims are a major cost of doing business—and this is especially true when the consuming public is put in close proximity to hot liquids, as is true in a commercial self-service coffee distribution business.

Injury claims drive up the cost of insurance premiums and divert time and the resources of the business into litigating claims and associated personal injury lawsuits.

Due to the numerous strong reasons as described above, the device of Hlavacek is commercially unviable in the coffee self-service environment.

U.S. Pat. No. 4,383,422 to Gordon discloses a portable insulated holder for beverage containers. Unlike the present invention, it fails to securely hold the beverage container in place during severe pouring angles. Also unlike the present invention, Gordon has no pouring handle because Gordon was not designed as a receptacle for a milk carton and for facilitating pouring of milk from the nested milk carton. In addition, Gordon lacks means of any kind to snugly fit any food container, and accordingly, Gordon's invention has no means to ensure a snug fit.

U.S. Pat. No. 4,338,795 to House discloses a beverage insulating and cooling receptacle with an insulating base and a cooling cap. Unlike the present invention, House has no means to ensure a snug fit, and no anti-slide clips and requires a bottle cap to protect the bottle contents. In contrast, the present invention uses only the features of the nested milk carton itself to protect the milk. Typically, milk cartons have reclosable paper folds, thus eliminating the need for House's bottle cap in the present invention.

U.S. Pat. No. 4,218,961 to Batchelor discloses a device for canisters and a reclosure for vacuum pack containers having a removable diaphragm that seals with the open end of the container and a cover overlying the diaphragm to form a pump chamber therebetween. Aside from being a container device, there is otherwise little similarity in structure between Batchelor and the present invention.

U.S. Pat. No. 4,183,226 to Moore discloses means for chilling and insulating a canned or bottled beverage—and has a cylindrical sleeve configuration. The present invention is preferably not cylindrical, since most commercially available milk containers are square or rectangular in cross section, and the present invention is directed toward a commercially viable passive thermal insulator for milk containers. Unlike the present invention, Moore has no means for preventing a nested container from slipping out when exposed to a severe pouring angle, and no pouring handle. Another U.S. Patent to Moore, No. 4,163,374, is similar in relevant comparison to the present invention, and the foregoing discussion of Moore's above-described U.S. Pat. No. 4,183,226 applies as well to his U.S. Pat. No. 4,163,374.

U.S. Pat. No. 3,823,567 to Corini for a thermoelectric vacuum shipping container discloses inner and outer shells. Due to the active rather than passive refrigeration, the shape, features and design of Corini make it commercially non-viable for a coffee self-service for many of the same reasons that the above described is not commercially viable.

In addition, Corini does not solve the problems which the present invention does—because Corini provides a refrigerated box, not a user graspable beverage container as in the present invention, and Corini thus fails to snugly nest a beverage container, has no shims or pour handle as does the present invention, and Corini has no slide-out prevention clips because they are not appropriate to the design of Corini.

Thus, Corini is not specifically directed to cheaply, safely and conveniently keeping milk refrigerated and easy to pour in a coffee self-service environment as is the present invention.

U.S. Pat. No. 3,273,354 to Gibson discloses a thermal insulating and cooling receptacle for disposable fluid containers. Unlike the present invention, Gibson has a refrigerant cap with a refreezable fluid for cooling the liquid in a disposable container. However, Gibson fails to provide anti-slide means as does the present invention for holding the milk container nested in the receptacle during steep pouring angles. Gibson lacks a pouring handle and snugging means also provided by the present invention because Gibson' device is a holder, not a dispenser. Further Gibson's device must use its cover to perform its intended function, whereas the present invention not only needs no cover, but also seeks to avoid having a cover so as to increase user convenience and safety.

Furthermore, in Gibson, freezable liquid is found in the top portion of the device, making it top-heavy and therefore unstable as a dispenser and absolutely dangerous in a coffee self-service environment.

U.S. Pat. No. 4,485,636 to Hilado discloses a container for cooling and/or keeping cold beverages or foods. Hilado's device has double walls for insulation and accommodates a re-freezable fluid for cooling the contents. A stress-relieving diaphragm accommodates the expansion of the fluid upon chilling to prevent breakage of the container.

Hilado's device has no pour handle, no snugging means, and no anti-slide means as does the present invention.

U.S. Pat. No. 3,302,427 to Stoner discloses a device for cooling or keeping cool a cylindrical can of liquid. It is directed toward drinking a beverage directly from a can, and cooling the canned liquid before consumption. Stoner's device chills the beverage, which would otherwise be chilled by adding ice thereto. Since with Stoner's device the user drinks directly from the can, there is no opportunity to add ice to the beverage.

Stoner's device has no anti-slide means, no snugging means, and is designed for a cylindrical container, not a square-cross-section milk container as is the present invention.

U.S. Pat. No. 5,001,907 to LaCroix discloses a beverage container including an inner tubular wall defining a reservoir having a refrigerant gel for maintaining beverages in a chilled state. The device of LaCroix is designed primarily for a beverage to be poured into it. It is non-insulated, has no method to let air escape if a user tried to insert an existing container and does not address holding a container in place during times when there is a steep pouring angle.

U.S. Pat. No. 4,981,234 to Slaughter discloses an improved food container for maintaining food at reduced temperatures. It has an upper opening inner shell surrounded by an outer shell between which is a cavity filled with a gelatinous blend of amorphous natural high-polymer carbohydrates. The device of Slaughter is an expensive food container designed to hold food products inside of it, but not to act as a dispenser or cooling sleeve, which nests an existing milk container. Slaughter's device has no handle, no air-release means and no locking means to prevent a container held therein from unwanted slip-out.

OBJECTS OF THE INVENTION

To overcome the disadvantages of the prior art, it is an object of the present invention to provide an inexpensive milk-cooling dispenser for self-service coffee distribution.

It is a further object of the present invention to provide a safe milk dispenser in a commercial coffee self-service environment.

It is yet another object of the present invention to provide a safe milk dispenser in an environment in which consumers are exposed to and actually handle hot liquids.

It is another object of the invention to provide an insulating milk dispenser, which prevents unwanted slip-out of the milk carton therein.

It is an object of the present invention to provide convenient milk dispensing for self-service coffee distribution which avoids open ice refrigeration with the consequent accidental water dripping and puddling associated therewith.

It is an object of the present invention to provide passive thermal insulation in an inexpensive, convenient manner, which is commercially viable for self-service coffee distribution.

It is still another object of the invention to vent air, which must leave and enter an insulated dispenser when milk cartons are installed or removed, respectively.

It is an object of the present invention to provide an insulated milk dispenser, which requires little or no maintenance and is easy to clean.

It is an object of the present invention to provide an insulated milk dispenser that may use refreezable refrigerant gel in its bottom portion so as to enhance the passive cooling and refrigeration of milk in a nested carton.

It is a further object of the present invention to provide a refreezable refrigerant gel in at least one recess comprising a portion of the nest cavity so as to assist in maintaining acceptable milk temperature in a counter-top non-refrigerated environment for an extended period of time.

It is a further object of the present invention to provide a suitable low center of gravity of a milk-dispensing receptacle so as to minimize the risk of spills or dropping of the container by infirm or distracted users or children.

It is a further object of the present invention to increase the profitability of coffee self-service by reducing the risk of injury from coffee spills by providing a safer milk dispenser.

It is an object of the present invention to provide an insulated milk dispenser having a temperature indicator for room temperature counter-top commercial coffee self-service.

It is an object of the present invention to provide an insulated milk dispenser having sides that accept printing to facilitate the application of advertising indicia.

It is an object of the present invention to provide an insulated milk dispenser having a relatively low center of gravity.

It is an object of the present invention to provide an insulated milk dispenser having identifiable indicia thereon to make it easy to identify the milk product therein, such as 2% milk, non-fat milk, half and half, and so forth.

It is an object of the present invention to provide an insulated milk dispenser that is light in weight and easily cleaned.

It is also an object of the present invention to overcome the disadvantages of the prior art.

SUMMARY OF THE INVENTION

In keeping with the aforesaid objects of the invention and others which may become apparent, the present invention provides is a simple, inexpensive, convenient passively insulating milk dispenser for coffee-drinker self-service. The milk dispenser of the present invention is for placement in a location convenient for coffee self-service, typically near a coffee dispenser and always in a room-temperature location. The present invention is constructed to have dimensions so as to snugly hold a milk container in a frame having a convenient pouring handle.

The present invention eliminates all the problems with placing a milk container into an ice pan because the dispenser of the present invention is simply a frame having an outer shell with a pour-handle and flexible milk carton retaining flaps in the preferred embodiment. A non-preferred embodiment employs a user-installed locking clip to prevent unwanted milk carton slide-out.

The preferred embodiment of the present invention contains soft thermally insulating cell foam, preferably provided with permanently installed re-freezable gel-ice, which cell foam with or without refrigerant gel fits within the frame, forming a receptacle with a bottom drain aperture for a coffee-service milk container. When the milk container is placed therein it is snugly held in place by the cell foam and by the retaining flaps and the milk container is preferably in contact with the refrigerant gel.

The outer shell of the present invention may be made of a suitably inexpensive material such as plastic, and may be imprinted with advertising indicia if desired.

The present invention solves the problem of making milk safely and conveniently available to coffee self-service customers in a commercial environment where milk containers are now typically left thermally unprotected or are placed in a messy, dangerously drip-producing ice bath. These problems exist not because there is no know-how to solve them, but because commercial realities dictate simple non-fancy self-service milk be made available to coffee self-servers in a commercial environment.

In addition, also in a non-preferred embodiment, the present invention may be provided with a plurality of accessory cell foam shims which are wafer-like thin and flat pieces of cell foam whose length and width permit them to be inserted between a beverage container and the cell foam nest of the present invention for making the beverage container fit within its cell foam nest as snugly as the user desires. The shims are thus for user-adjustment of the sizing the cell foam nest so as to ensure that the different-sized beverage containers are snugly fitted within the nest and also thermally insulated in the simplest, most cost effective and most thermally efficient manner.

The outer shell and inner lining of the present invention are designed to accept a standard milk carton nested inside so that the top of the sides of the present invention permit the top of a standard milk carton to project above the confines of the present invention when nested. In use, only the pouring top of the milk carton projects above the walls of the milk dispenser of the present invention.

In a non-preferred embodiment of the present invention, a user-removable cap for the milk carton is provided for use during periods of slow commercial activity. The cap assists with thermal insulation and is constructed of the same materials as the receptacle, and has an outer shell made of the same material as the outer shell of the receptacle discussed herein, with a soft foam lining having a nest cut out from within for matching the contours of the top of a standard milk carton. The cap is thus easily fitted onto the top of a milk carton protruding from the receptacle of the present invention, and the soft foam recess of the cap firmly grasps the contours of the top of the milk carton, with a firm grasp. The cap is held in place by friction fitting.

BRIEF DESCRIPTION OF THE DRAWINGS

The invention can best be understood in conjunction with the drawings, in which.

DETAILED DESCRIPTION OF THE DRAWINGS

Figure 1:
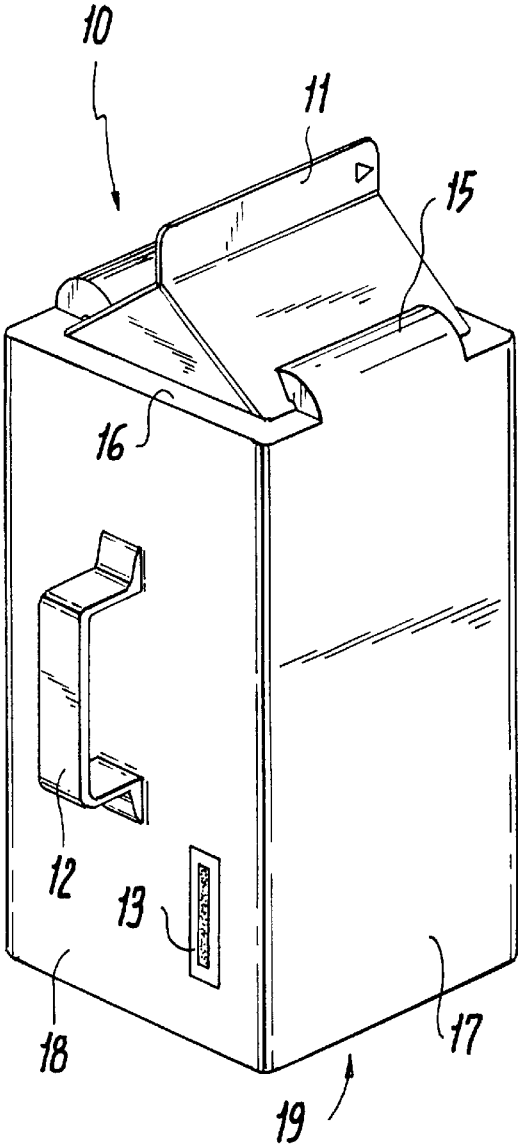
FIG. 1 shows a perspective view of the insulated receptacle of the present invention having flexible retaining flaps.

FIG. 1 shows a perspective view of the rectangular insulated receptacle 10 of the present invention having milk carton 11 nested therein, receptacle 10 also having rear wall 18 and side wall 17 as parts, respectively, of outer shell 19, where shell 19 is made of a material capable of accepting printed indicia for advertising purposes, such as smooth plastic. Receptacle 10 also has soft insulated cell foam 16, pour handle 12 disposed on rear wall 18 and optional, non-preferred colorimetric milk temperature indicator 13 disposed on rear wall 18.

Temperature indicator 13 provides a visual indication of the temperature of refrigerant gel, or the temperature of a nested milk carton within receptacle 10, indicator 13 being preferably a conventional colorimetric indicator with a varying color display to indicate varying temperatures. Indicator 13 is mounted so as to have effective temperature sensing contact with milk carton 11 nested within receptacle 10 or with the re-freezable gel. Such temperature sensing contact is preferably achieved by a thermal conductor member 51 shown in FIGS. 7 and 8. Thermal conductor 51 connects temperature indicator 13 with temperature sensor 52 by penetrating through thermal insulation 16, a shown in FIGS. 7 and 8.

Receptacle 10 is provided with a pair of flexible retaining flaps 15, which are respectively extensions of opposite side walls 17. Flexible retaining flaps 15 comprise flexible, inwardly curling stubs which is are extended upper portion of side walls 17. Flaps 15 are resiliently pliable to user finger pressure. To insert a milk or beverage carton into receptacle 10, the user's fingers pull back one of flaps 15 so that the pulled-back flap 15 is out of the path of the incoming beverage carton, which enters the receptacle at an angle due to the pulled-back flap 15. When the milk or beverage carton has sufficiently entered the foam cavity nest in receptacle 10, the user releases flap 15, which resiliently curls inward to contact the carton. When the carton is fully seated flaps 15 are in resilient contact with the angled shoulders of milk carton 11, as shown, and serve to hold carton 11 within receptacle 10 during times when a user employs a steep pouring angle. Such a steep pouring angle, as when there is very little milk left in the carton, could cause carton 11 to inadvertently slide out of receptacle 10 if there were no other means to retain it therein.

Figure 2:
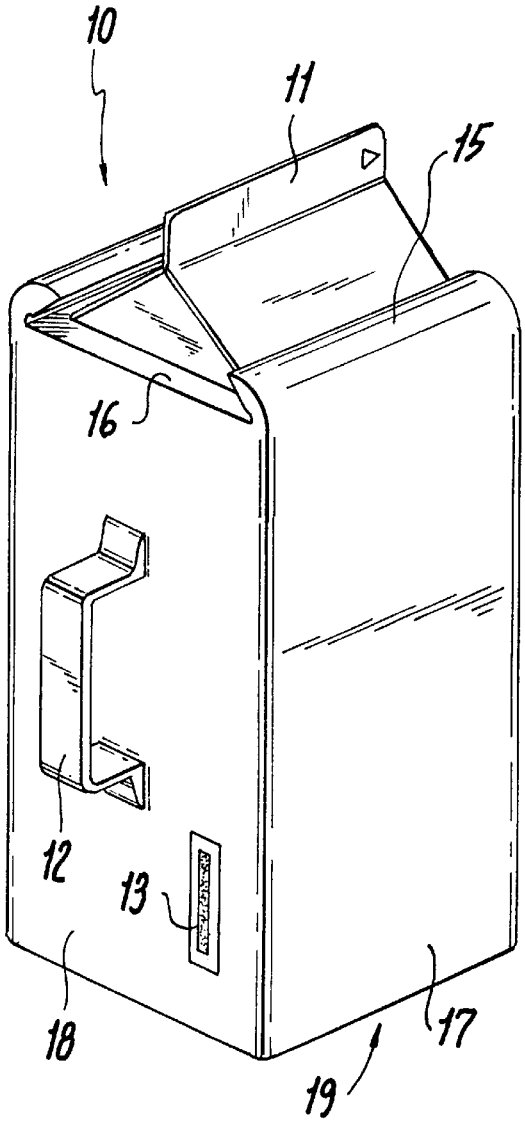
FIG. 2 shows a perspective of the receptacle of the present invention having flexible retaining flaps which extend the full dimensions of the angled shoulders of a milk or beverage carton nested therein.

FIG. 2 shows a perspective of the receptacle 10 of the present invention having flexible retaining flaps 15, which extend laterally for substantially all of the full dimensions of the angled shoulders of a milk carton nested therein. This is in comparison to the flexible retaining flaps shown in FIG. 1, which extend laterally for substantially less than all of the full dimensions of the angled shoulders of a milk carton.

Figure 3:
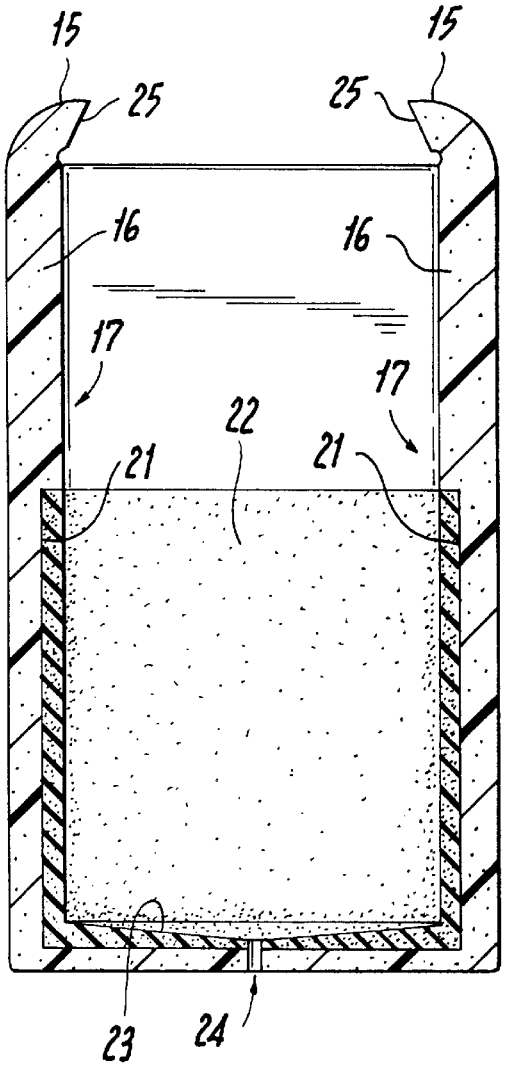
FIG. 3 shows a cross section of the receptacle of the present invention showing sides having inwardly curling flexible retaining flaps comprised of a combination of the outer shell and the soft inner foam, for retaining a milk or beverage carton therein, and a sloping nest floor to allow drainage of any moisture into the drain aperture. Also shown are recesses for accommodating refrigerant gel in the sides and bottom of the receptacle.

FIG. 3 shows a cross section of the receptacle of the present invention showing sides having inwardly curling flexible retaining flaps 15 comprised of a combination of side walls 17 and the soft inner foam 16, for grasping retaining a milk carton therein. The flexible flaps 15 preferably have the foam insulation edges beveled so as to form a contact surface 25 approximately parallel to the angled shoulders of a nested milk or beverage carton. The purpose of contact surfaces 25 is to provide secure contact between the flexible retaining flaps 15 and the carton, for preventing unwanted slip-out of the carton from its nest and also to provide increased thermal insulation.

Also shown in this cross-section of the insulated receptacle 10 are recesses 21 for accommodating refreezable refrigerant gel 22, air vent-drain aperture 24 for allowing moisture to drain and air to leave or to enter as a milk carton is respectively installed or removed from receptacle 10. FIG. 3 also shows insulating cell foam 16 and side walls 17.

The nest cavity of receptacle 10 also is provided with a concave, sloping nest floor 23 to allow drainage of any moisture into the drain aperture. In a non-preferred embodiment, the concave, sloping nest floor could comprise a plurality of ribs radially disposed around the drain aperture, so as to collect moisture between the ribs and allow it to drain directly into the aperture.

Figure 4:
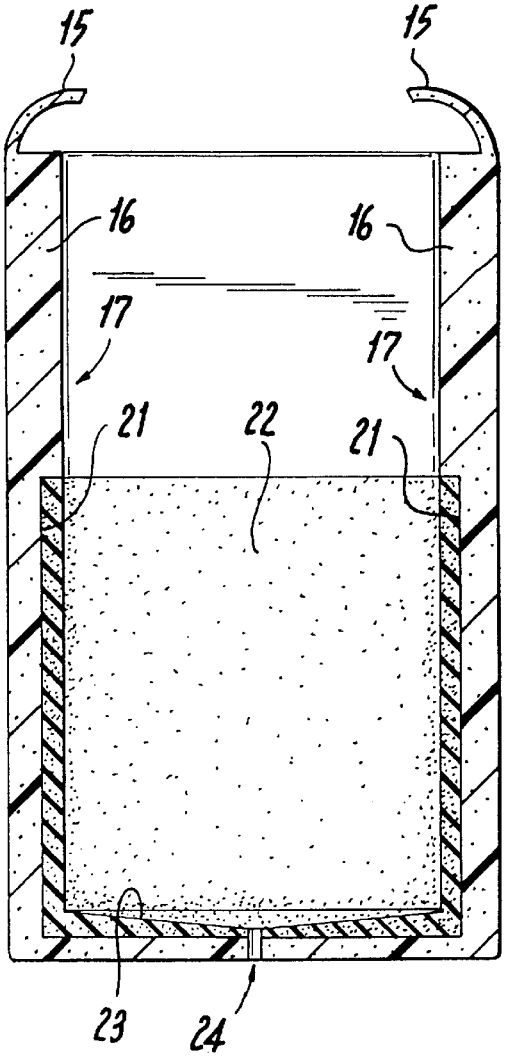
FIG. 4 shows a cross section as in FIG. 3, the difference being that the flexible retaining flaps are comprised only of the material of the outer shell of the receptacle. There is no foam insulation comprising the flexible retaining flaps.

FIG. 4 shows a cross section as in FIG. 3, the difference being that the flexible retaining flaps 15 are comprised only of the material of the outer shell of the receptacle. There is no foam insulation comprising the flexible retaining flaps.

Figure 5:
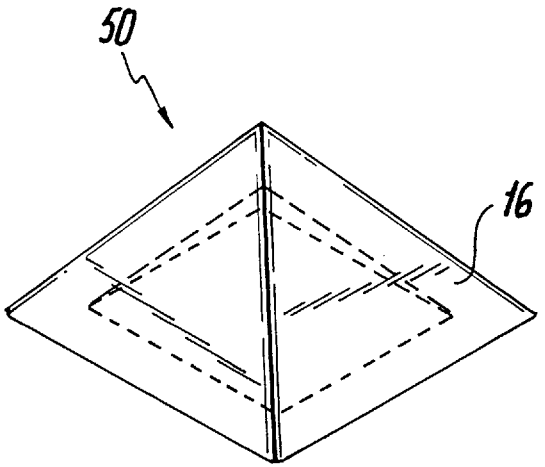
FIG. 5 shows a perspective view of an insulated container cap fitting onto the receptacle of the present invention.

FIG. 5 shows a perspective view of receptacle cap 50 having foam insulation 16 therein for placement on top of receptacle 10 during extended periods of receptacle residence on a counter top at room temperature.

Figure 6:
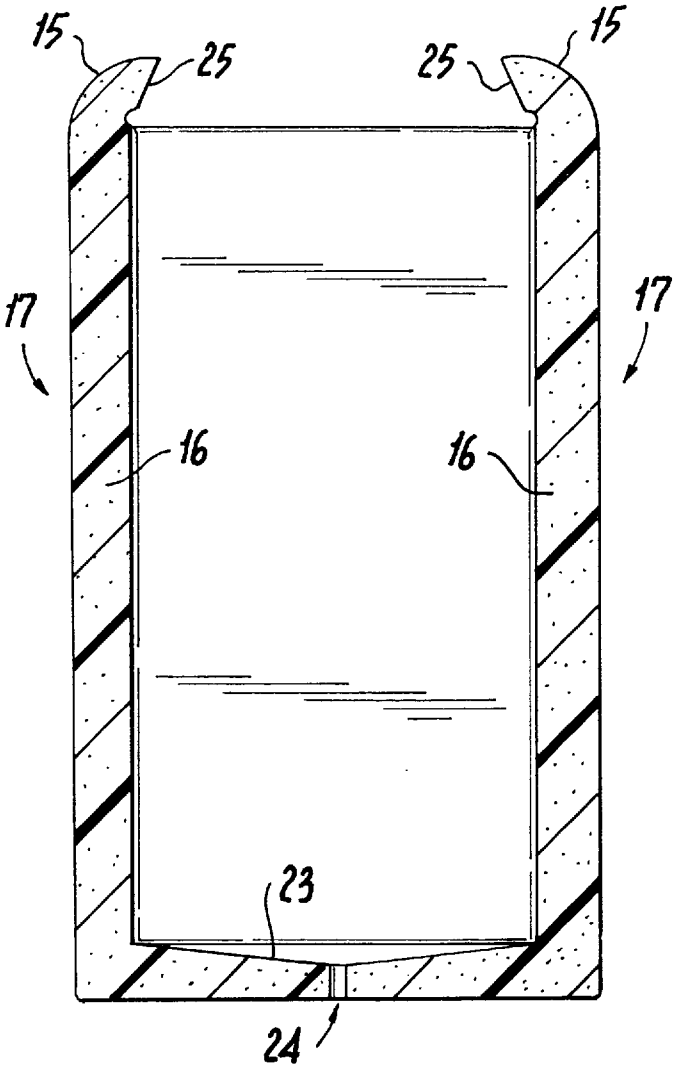
FIG. 6 shows a cross section of a non-preferred embodiment of the receptacle having no recesses and no refrigerant gel.

FIG. 6, similar to FIG. 3, shows a cross section of the receptacle of the present invention. However, not shown in the non-preferred embodiment of FIG. 6 are recesses 21 shown in FIG. 3. The recesses 21 are absent from FIG. 6 because the non-preferred embodiment shown in FIG. 6 has no refreezable refrigerant gel.

Figure 7:
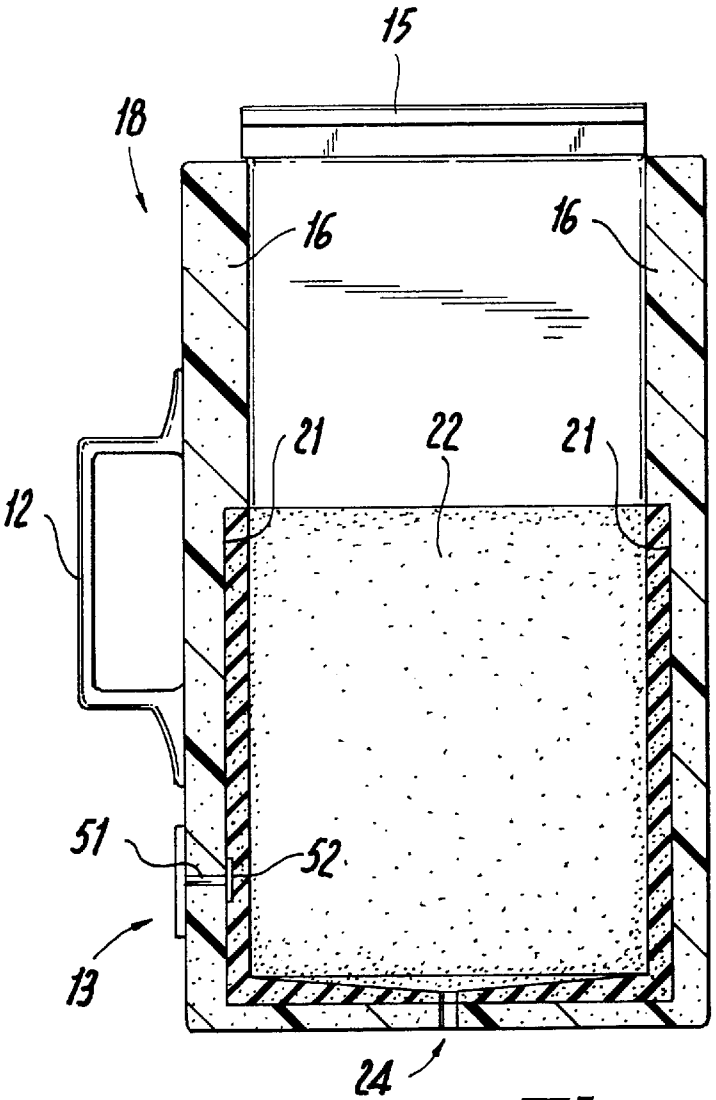
FIG. 7 shows a cross-section of a side view of a non-preferred embodiment of the receptacle showing a calorimetric temperature indicator having a through-the-wall thermal sensing contact member for contacting and sensing the temperature of the refrigerant gel.

FIG. 7 shows a cross-section of a side view of a non-preferred embodiment of the receptacle 10 showing a calorimetric temperature indicator 13 mounted on rear wall 18 where sensor 13 has a through-the-wall thermal conducting member 51 and thermal sensing contact member 52 for contacting and sensing the temperature of the refrigerant gel 22. Colorimetric temperature indicator 13 may be any well-known indicator, which gives a color change in response to differing temperatures. A user need simply view the temperature indicator to observe whether the color indicates a temperature that is at, above, or below an acceptable value.

Figure 8:
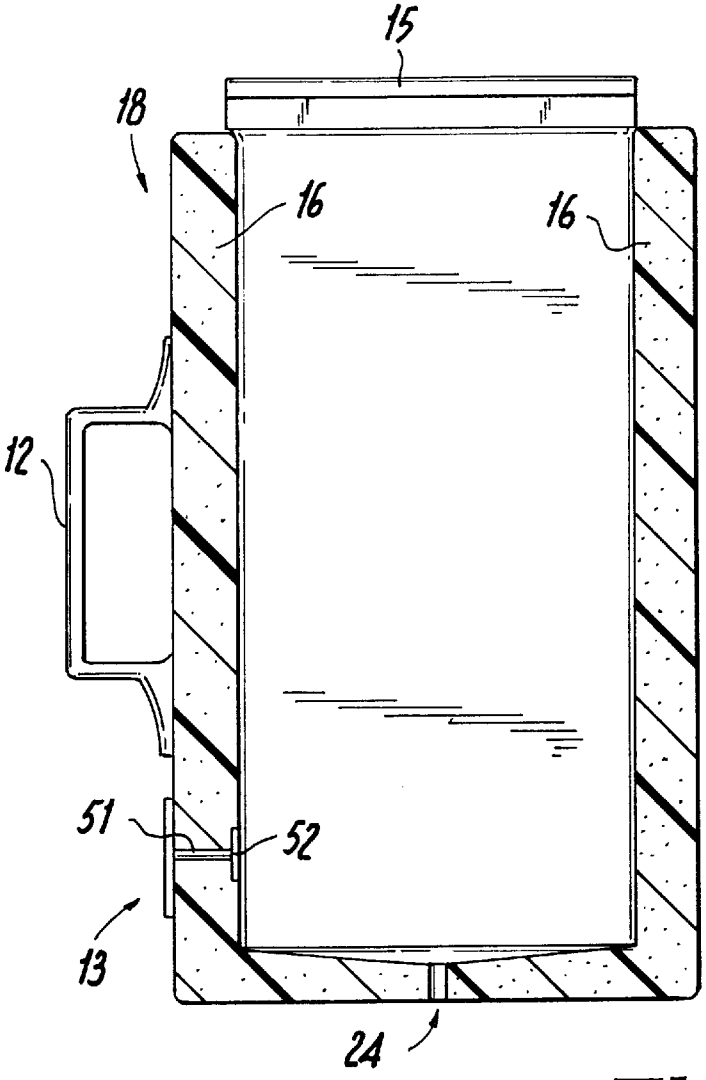
FIG. 8 shows a cross-section of a side view of a non-preferred embodiment of the receptacle without any refrigerant gel, showing a calorimetric temperature indicator having a through-the-wall thermal sensing contact member for contacting and sensing the temperature of a nested beverage carton. The present invention may provide temperature sensing contact directly with the beverage carton as in FIG. 8 even where refrigerant gel is provided as shown in such drawings as FIG. 7, but where an area of rear wall 18 is provided with an area having no refrigerant gel so as to permit the temperature sensor to extend through the insulated wall of the receptacle and directly contact the beverage container, as is shown in FIG. 8.

FIG. 8 shows a cross-section of a side view of a non-preferred embodiment of the receptacle 10 without any refrigerant gel, showing a calorimetric temperature indicator 13 mounted on rear wall 18, temperature indicator 13 having a through-the-wall thermal conducting member 51 and thermal sensing contact member 52 for directly contacting and sensing the temperature of a nested beverage carton. The present invention may provide temperature sensing contact directly with the beverage carton as in FIG. 8 even where refrigerant gel is provided as shown in such drawings as FIG. 7, but where an area of rear wall 18 is provided with an area having no refrigerant gel so as to permit the temperature sensor to extend through the insulated wall of the receptacle and directly contact the beverage container, as is shown in FIG. 8.

Further modifications may be made to the present invention without departing from its scope, as noted in the appended claims.

What is claimed is:

1. A thermally insulating receptacle for keeping a beverage cold, comprising:

an outer shell having four elongated walls and a bottom, defining a box, said box having a substantially rectangular cross section; and wherein said receptacle has an inner lining in contact with and coextensive with said outer shell, said inner lining being comprised of a suitable thermal insulating means wherein said inner lining defines a cavity having a floor and sidewalls for receiving and snugly grasping a beverage container nested therein; and wherein said elongated walls comprise a front wall, two respective, opposite side walls each respectively contiguous with said front wall, and a rear wall contiguous with said respective side walls, said rear wall having a pour handle affixed thereon; and wherein said receptacle has means for preventing a nested beverage carton from inadvertently slipping out from its nested position within said cavity, said means comprising at least one inwardly curling flexible retaining flap extending upwardly from the upper portion of at least one wall of said receptacle.

2. The device of claim 1 wherein said cavity floor and said bottom have a drain aperture extending therethrough for allowing moisture drainage and for allowing air venting during insertion and removal of beverage cartons into and out of the receptacle; and further wherein said thermal insulating means comprises thermal insulating foam.

3. A thermally insulating receptacle for keeping a beverage cold, comprising:

an outer shell having four elongated walls and a bottom, defining a box, said box having a substantially rectangular cross section; and wherein said receptacle has an inner lining in contact with and coextensive with said outer shell, said inner lining being comprised of a suitable thermal insulating means wherein said inner lining defines a cavity having a floor and sidewalls for receiving and snugly grasping a beverage container nested therein; and wherein said elongated walls comprise a front wall, two respective, opposite side walls each respectively contiguous with said front wall, and a rear wall contiguous with said respective side walls, said rear wall having a pour handle affixed thereon; and wherein said receptacle has means for preventing a nested beverage carton from inadvertently slipping out from its nested position within said cavity, said means comprising a plurality of user insertable auxiliary wafers of thermal insulating material for insertion into the space between a nested beverage carton and the inner lining so as to increase the snugness.

4. The device of claim 2 wherein said inner lining comprises at least one recess in the lower portion of said lining, said at least one recess having re-freezable refrigerant gel installed within the at least one recess; and wherein said refrigerant gel smoothly matches the receptacle's inner lining for snug nesting of a beverage carton and for effective thermal contact between the beverage carton and the refrigerant gel.

5. The device of claim 4 wherein said cavity floor comprises a slightly concave surface having a lowest point at the drain aperture; and wherein said cavity floor has a plurality of raised ribs radially disposed around the drain aperture, for permitting the collection and drainage of moisture between the ribs and the runoff of the moisture directly into said drain aperture.

6. The device of claim 4 wherein said refrigerant gel comprises at least one auxiliary removable separately refreezable gel unit for user installation into and removal from said at least one recess.

7. The device of claim 4 wherein said at least one inwardly curling flexible retaining flay is comprised of an upward extension of said outer shell in combination with said insulating foam of said lining of said receptacle, said foam comprising a contact surface for retentively contacting a beverage carton in the manner of a retaining spring for preventing undesirable slip-out of the beverage carton from its nest in said receptacle.

8. The device of claim 7 wherein said at least one contact surface is beveled so as to provide for said contact surface to substantially match the contour of at least one angled shoulder surface of a standard beverage carton; said beveled contact surface being for retentively contacting a standard beverage carton nested within said receptacle.

9. The device of claim 8 wherein said at least one contact surface extends horizontally so as to be coextensive with substantially the entire width of an angled shoulder of a standard beverage carton being retained.

10. The device of claim 8 wherein said at least one contact surface extends horizontally so as to be coextensive with substantially less than the entire width of an angled shoulder of a standard beverage carton being retained.

11. The device of claim 7 wherein said at least one inwardly curling flexible retaining flap is comprised of said outer shell of said receptacle without said insulating foam of said lining.

12. The device of claim 7 having a colorimetric temperature indicator disposed on its outer shell, the indicator being in temperature-sensing contact with the refrigerant gel.

13. The device of claim 7 having a calorimetric temperature indicator disposed on its outer shell, the indicator being in temperature-sensing contact with a beverage carton nested therein.

14. The device of claim 4 wherein said means for preventing a nested beverage carton from inadvertently slipping out from its nested position within said cavity comprises a pair of inwardly curling flexible retaining flaps extending upwardly from said upper portions of said opposing side walls of said receptacle.

15. The device of claim 14 wherein said inwardly curling flexible retaining flaps are comprised of respective upward extensions of said opposite side walls of said outer shell in combination with said insulating foam of said lining of said receptacle said foam comprising respective contact surfaces in the manner of retaining springs for preventing undesirable slip-out of the beverage carton from its nest in said receptacle.

16. The device of claim 15 wherein said contact surfaces are beveled so as to provide for said contact surfaces to substantially match the contour of angled shoulder surfaces of a standard beverage carton; said beveled contact surfaces being for retentively contacting a standard beverage carton nested within said receptacle.

17. The device of claim 16 wherein said contact surfaces extend horizontally so as to be coextensive with substantially the entire width of respective angled shoulders of a standard beverage carton being retained.

18. The device of claim 16 wherein said contact surfaces extend horizontally so as to be coextensive with substantially less than the entire width of respective angled shoulders of a standard beverage carton being retained.

19. The device of claim 15 wherein said inwardly curling flexible retaining flaps are comprised of said outer shell of said receptacle without said insulating foam of said lining.

20. The device of claim 15 wherein said refrigerant gel comprises at least one auxiliary removable separately refreezable gel unit for user installation into and removal from said at least one recess.

21. The device of claim 3 wherein said inner lining comprises at least one recess in the lower portion of said lining, said at least one recess having re-freezable refrigerant gel installed within the at least one recess; and wherein said refrigerant gel smoothly matches the receptacle's inner lining for snug nesting of a beverage carton and for effective thermal contact between the beverage carton and the refrigerant gel.

22. The device of claim 21 wherein said cavity floor comprises a slightly concave surface having a lowest point at the drain aperture; and wherein said cavity floor has a plurality of raised ribs radially disposed around the drain aperture, for permitting the collection and drainage of moisture between the ribs and the runoff of the moisture directly into said drain aperture.

23. The device of claim 22 wherein said refrigerant gel comprises at least one auxiliary removable separately refreezable gel unit for user installation into and removal from said at least one recess.

* * * * *